US006605186B2

(12) United States Patent
Miller

(10) Patent No.: US 6,605,186 B2
(45) Date of Patent: Aug. 12, 2003

(54) HEADBOX FOR GYPSUM/FIBER BOARD PRODUCTION

(75) Inventor: David Paul Miller, Lindenhurst, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 10/151,749

(22) Filed: May 17, 2002

(65) Prior Publication Data

US 2002/0148586 A1 Oct. 17, 2002

Related U.S. Application Data

(60) Division of application No. 09/571,837, filed on May 16, 2000, now Pat. No. 6,413,376, which is a continuation-in-part of application No. 09/020,811, filed on Feb. 9, 1998, now abandoned.

(51) Int. Cl.[7] ..... D21F 11/00; D21F 1/18; D21F 1/00

(52) U.S. Cl. ..... 162/216; 162/342; 162/341; 162/336

(58) Field of Search ..... 162/336, 342, 162/341, 216, 344

(56) References Cited

U.S. PATENT DOCUMENTS

| | | | |
|---|---|---|---|
| 1,240,589 | A | 9/1917 | Murray |
| 1,664,722 | A | 4/1928 | Yoder |
| 1,841,693 | A | 1/1932 | Aldrich et al. |
| 2,728,271 | A | 12/1955 | Witworth et al. |
| 2,782,692 | A | 2/1957 | Boronow et al. |
| 2,934,142 | A | 4/1960 | Ikavalko |
| 3,164,513 | A | 1/1965 | Calehuff |
| 3,165,438 | A | 1/1965 | Dennis et al. |
| 3,979,254 | A | 9/1976 | McIntyre |
| 3,980,518 | A | 9/1976 | Ljung et al. |
| 4,265,979 | A | 5/1981 | Baehr et al. |
| 4,508,595 | A | 4/1985 | Gasland |
| 4,816,091 | A | 3/1989 | Miller |
| 4,895,624 | A | 1/1990 | Koivisto et al. |
| 5,277,765 | A | 1/1994 | Graf et al. |
| 5,298,126 | A | 3/1994 | Dahl |
| 5,320,677 | A | 6/1994 | Baig |

FOREIGN PATENT DOCUMENTS

| | | |
|---|---|---|
| CA | 646664 | 8/1962 |
| DE | 189059 | 5/1905 |
| SU | 678115 | 8/1979 |

OTHER PUBLICATIONS

Handbook of Pulp and Paper Technology, Kenneth W. Britt (1970), pp. 381 to 399.
Handbook for Pulp & Paper Technologists, Second Edition, Gary A Smook (1992), pp. 230 to 239.
Pulp and Paper Manufacture, Third Edition, Benjamin A. Throp, (1991) pp. 97 to 116.

*Primary Examiner*—Dionne A. Walls
(74) *Attorney, Agent, or Firm*—Donald E. Egan; John M. Lorenzen; David F. Jancl

(57) ABSTRACT

A headbox for use in a water felting process includes a housing and two rotating horizontal distribution rolls. The housing has curved sections shaped to conform to the outer cylindrical surface of the distribution rolls, wherein the curved section is closely spaced to a portion of the outer cylindrical surface of both distribution rolls.

22 Claims, 5 Drawing Sheets

HEADBOX FOR GYPSUM/FIBER BOARD PRODUCTION

This is a Division of application Ser. No. 09/571,837 filed May 16, 2000 now U.S. Pat. No. 6,413,376 which in turn is a Continuation in Part of application Ser. No. 09/020, 811 Feb. 9, 1998 (now abandoned).

FIELD OF THE INVENTION

The present invention relates to a headbox to uniformly distribute a reactive, aqueous suspension of calcium sulfate hemi-hydrate crystals and fibers across the width of a foraminous wire mesh in a water-felting process to form a uniform gypsum/fiber web. More specifically, the headbox of the present invention may be used to distribute hot suspensions of calcium sulfate hemi-hydrate crystals and lignocellulose fibers, such as paper fibers or wood fibers, although the headbox of the present invention also may be used to distribute suspensions of other dense crystals and any fibrous materials.

BACKGROUND AND PRIOR ART

The process of water felting dilute aqueous dispersions of various fibrous materials is a well-known commercial process for manufacturing many types of paper and board products. In this process, an aqueous dispersion of fiber, binder and other ingredients, as desired or necessary, is flowed onto a moving foraminous support wire, such as that of a Fourdrinier or Oliver mat forming machine, for dewatering. The dispersion may be first dewatered by gravity and then dewatered by vacuum suction means; the wet mat is then pressed to a specified thickness between rolls and the support wire to remove additional water. The pressed mat is then dried in heated convection or forced air drying ovens, and the dried material is cut to the desired dimensions.

U.S. Pat. No. 5,320,677 to Baig describes a composite material made from gypsum and host particles of a reinforcing material, such as lignocellulose fibers, hereinafter sometimes referred to as gypsum/wood fiber board. The composite material is produced by mixing gypsum and host particles of a stronger substance, such as wood fibers, in a dilute aqueous slurry. The slurry is heated in an autoclave, preferably under pressure, to convert the gypsum to calcium sulfate alpha hemihydrate. The hot, converted slurry is discharged through a headbox onto a continuous felting conveyor of the type used in paper making operations, where the slurry is dewatered to remove as much uncombined water as possible before rehydrating the hemihydrate back to gypsum. The resulting material is a homogeneous mass comprising gypsum crystals physically interlocked with the discrete host particles. The resulting mat is then dried in heated convection or forced air drying ovens, and the dried board is cut to the desired dimensions.

In order to produce the best composite product it is essential to spread the hot, reactive gypsum/fiber slurry uniformly across the width of the felting conveyor. The headbox of the present invention functions to spread the aqueous gypsum/fiber slurry over a moving wire screen much like the headboxes used in papermaking. However, the aqueous gypsum/fiber slurry differs from conventional papermaking stock in that the aqueous gypsum/fiber slurry is hot and reactive and has much higher solids than traditional papermaking slurries. The aqueous gypsum/fiber slurry to which the present invention pertains is comprised of two materials having markedly different densities. For example, the gypsum/fiber slurry may contain as much as 30% by weight of solids, of which from 80–97.5% by weight is high-density gypsum and 2.5–20% by weight is low-density paper fibers. Because of the disparate density of the components, the aqueous gypsum/fiber slurry must be constantly agitated, but the agitation must be in a manner that avoids breaking down the friable acicular calcium sulfate hemihydrate crystals. The particular nature of the aqueous gypsum/fiber slurry imposes special requirements on the headbox design.

In the formation of gypsum/fiber board products using such a water felting process, one measure of board quality is the formation property, that is, the degree of uniformity of distribution of solid components or fibers in the finished board. This formation property, while dependent upon many factors inherent in individual water felting process machines, is determined to a large extent by the flow pattern of gypsum/fiber stock from the sluice of the headbox onto the Fourdrinier wire or the web formation surface, and by the flocculated or unflocculated state of the fibers in the gypsum/wood fiber stock flow. Thus, if the gypsum/fiber stock flow onto the formation surface is uneven across the width of the surface, is uneven throughout the course of the machine run, or if the gypsum/fibers deposited onto the formation surface are in a non-uniformly flocculated state, the finished board will show stripes, ripples, density spots, strength variations and the like, characteristic of nonuniform distribution of fiber components. It is obvious, of course, that in the manufacture of quality board the formation property must be stringently controlled to insure a completely uniform distribution of gypsum/fibers onto the formation surface both by presenting an even stock flow and unflocculated fibers in the stock flow. Accordingly, control of the evenness of the stock flow and the flocculation of the fibers is very important inasmuch as even slight variations in gypsum/fiber stock flow or slight variations in the flocculation of the gypsum/fibers are sufficient to introduce serious non-uniformity to the finished board.

It is the general object of the present invention to provide a headbox for a Fourdrinier machine that produces a uniform distribution of the gypsum/fiber stock across the width of the Fourdrinier wire.

A more specific object of the Invention is to provide a headbox for a Fourdrinier machine having an improved structure for controlling the factors contributing to the formation property of the gypsum/fiber board produced thereby, particularly where low slurry flow rates and/or high solids contents are required.

Another object of the Invention is to provide improved turbulence generating distribution rolls by means of which the formation property of a gypsum/fiber board may be better controlled.

Another object of the invention is to provide improved distribution rolls for the headbox of a Fourdrinier machine by means of which sufficient controlled turbulence is introduced into the gypsum/wood fiber stock flowing therein to maintain the gypsum/wood fiber stock in a controlled state of flocculation.

Another object of the invention is to provide a distribution roll for the headbox of a Fourdrinier machine having an improved grid structure, preferably a diamond pattern, by means of which fibers in the gypsum/fiber stock are maintained in a controlled state of flocculation and the velocity profile of the gypsum/fiber stock flow is smoothed.

An additional object of the invention is to provide improved turbulence generating distribution rolls having sufficient openness to effectively smooth the velocity profile of the gypsum/wood fiber stock flowing in the headbox and of sufficient rigidity so as to be substantially unflexible when supported at its ends for rotation about its longitudinal axis.

A more specific object of the invention is to provide improved turbulence generating distribution rolls for which the surface solidity is less than 80% and which is sufficiently rigid to prevent flexing when the structure is supported at its ends for rotation about its longitudinal axis.

Another specific object of the invention is to provide improved turbulence generating distribution rolls having a solidity of between 65% and 80% of the area of its cylindrical surface, that is, an openness of between 20% and 35%.

BRIEF DESCRIPTION OF THE INVENTION

The present invention is a headbox for distributing a hot aqueous dispersion of calcium sulfate hemi-hydrate crystals and non-gypsum fiber uniformly across the width of the forming wire of a Fourdrinier machine or the like. The headbox of the present invention is described herein in the context of distributing a hot suspension of gypsum crystals and lignocellulose fibers, such as paper fibers or wood fibers, as described in U.S. Pat. No. 5,320,677 to Baig. However, the headbox of the present invention may also be used to distribute suspensions of other dense crystals and any fibrous material.

The headbox generally comprises a housing and two horizontal, counter-rotating, perforated distribution rolls that extend substantially across the width of the Fourdrinier forming wire. The housing includes a first curved section that is shaped to match the curvature of the cylindrical surface of the first distribution roll. The housing includes a second curved section that is shaped to match the curvature of the cylindrical surface of the second distribution roll. The two curved sections extend across the width of the headbox.

The distribution rolls are positioned in the housing wherein the cylindrical surface of the distribution rolls is closely spaced to the curved section of the housing. The rotation of the roll imparts energy to the fluid in the boundary layer of the slurry in contact with the roll. The rotating roll thus causes a pumping and mixing action in the slurry located in the gap between the rotating distribution roll and the static curved section of the housing and thus provides the desired controlled agitation of the gypsum/fiber stock without high shear. The level of agitation is a function of the roll speed and the spacing between the moving surface of the roll and the adjacent static curved section.

As the space between the roll and the curved section increases, the viscous drag decreases. As a result, the spacing between the rotating roll and the static curved section is important. As this spacing increases at the same roll rpm, the pumping and mixing action of the slurry in the spacing decreases. To maintain the same pumping and mixing action as the spacing between the roll and curved section increases, the roll rpm can be increased. In practice, the spacing between the roll and curved section is minimized so that the greatest range of roll speed can be utilized. The spacing is practically determined by the minimum spacing that does not encounter plugging of large clumps of slurry solids entering the headbox. Preferably, a weir formed by the intersection of the two curved sections separates the distribution rolls.

An overhead manifold feeds the hot aqueous dispersion of gypsum crystals and fiber, at multiple points across the width of the headbox, to a chute adjacent to the space between the housing curved section and the first distribution roll. The first distribution roll rotates toward (countercurrent) the incoming aqueous dispersion, while the second distribution roll rotates with (concurrent) the aqueous dispersion flowing over the weir.

The distribution rolls are both preferably perforated. The first roll, which is preferably larger, e.g. 10 inches (254 mm), has a plurality of round holes, preferably set in a diamond pattern. Preferably, the holes in the first roll are about 1 inch (25.4 mm) in diameter. From about 25 to about 35% of the cylindrical surface of the first roll may be perforated, i.e. open space, and preferably about 30% of the first roll is open space.

The second roll, which is smaller, e.g. 7 inches (179 mm), has a plurality of round holes set in a regular pattern. Preferably, the holes in the second roll are about 1½ inch (38.1 mm) in diameter. From about 20 to about 30% of the cylindrical surface of the second roll may be perforated, and preferably about 25% of the second roll is open space. The speed of the roll rotation may be independently varied to control flow patterns, but a peripheral speed of about 120 to 180 feet per minute (36.6 to 54.9 meters per minute) is preferred.

A second embodiment of the headbox of the present invention is also disclosed. In this embodiment, a first rotating horizontal distribution roll is also positioned in the housing, and a second rotating horizontal distribution roll is positioned in the housing, but the first distribution roll is more or less vertically disposed beneath said second distribution roll. In this embodiment the curved sections are closely spaced to the most of the surface of the corresponding rolls e.g. 270° or 300°. The curved sections of the housing extend around the rolls and intersect along two parallel lines to form a throat between the rolls that extends across the width of said rolls.

It is to be understood that the foregoing general description, and the following detailed description, are exemplary and explanatory only and are not restrictive of the invention, as claimed.

The accompanying drawings, which are incorporated in and constitute a partial disclosure of the present invention, illustrate two specific embodiments of the headbox of the present invention.

DETAILED DESCRIPTION OF THE INVENTION

Figure 1:
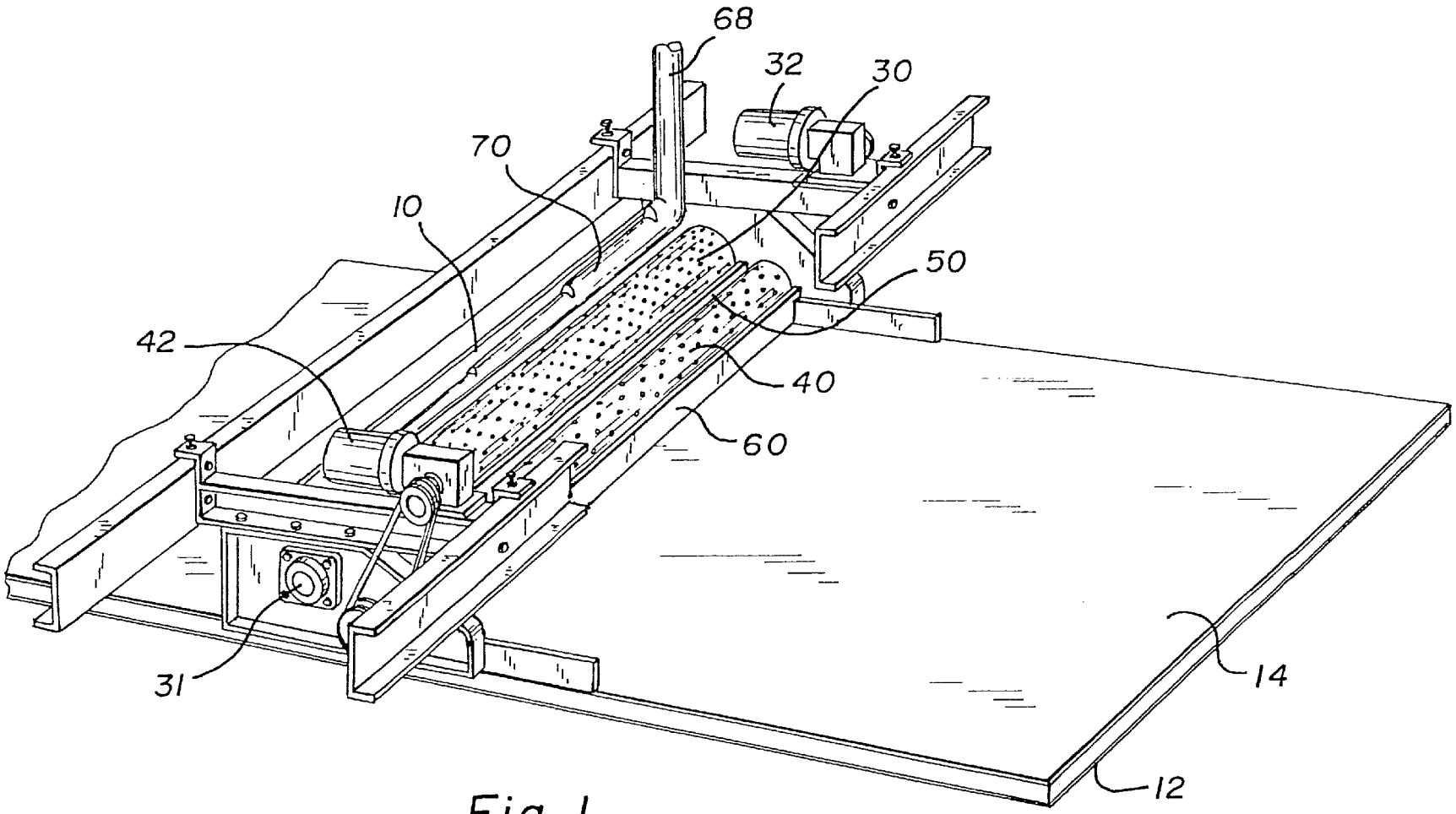
FIG. 1 is a perspective view of the headbox of my invention illustrating the positioning of the headbox relative to a basemat being formed on a conventional Fourdrinier forming wire.
Figure 2:
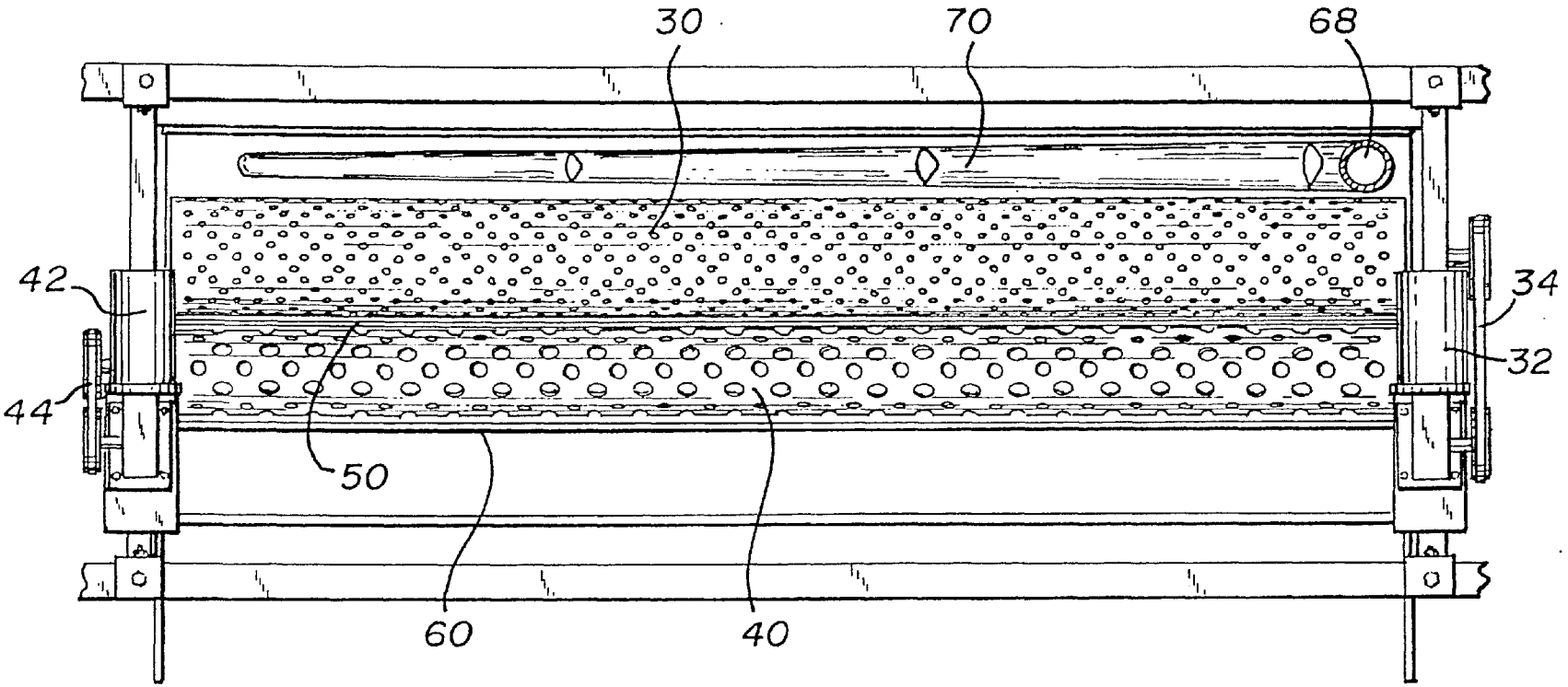
FIG. 2 is a top view of the headbox of my invention.

FIG. 1 illustrates headbox 10 positioned above a conventional Fourdrinier forming wire 12 on which a basemat 14 is being formed.

Headbox 10 of the present invention generally comprises a housing 20, and two perforated, horizontal distribution rolls 30 and 40 which extend across the with of the Fourdrinier forming wire 12. As is shown more clearly in FIG. 6, housing 20 includes two curved sections 36 and 46, which extend across the width of the Fourdrinier wire 12, and which are closely spaced to the lower portion of rolls 30 and 40, respectively.

The distribution rolls are positioned in the housing wherein the cylindrical surface of the distribution rolls is closely spaced to the curved curved section of the housing. The rotation of the roll imparts energy to the fluid in the boundary layer of the slurry in contact with the roll. The rotating roll thus causes a pumping and mixing action in the slurry located in the gap between the rotating distribution roll and the static curved section of the housing and thus provides the desired controlled agitation of the gypsum/fiber stock without high shear. The level of agitation is a function of the roll speed and the spacing between the moving surface of the roll and the adjacent static curved section.

As the space between the roll and the curved section increases, the viscous drag decreases. As a result, the spacing between the rotating roll and the static curved section is important. As this spacing increases at the same roll rpm, the pumping and mixing action of the slurry in the spacing decreases. To maintain the same pumping and mixing action as the spacing between the roll and curved section increases, the roll rpm can be increased. In practice, the spacing between the roll and curved section is minimized so that the greatest range of roll speed can be utilized. The spacing is practically determined by the minimum spacing that does not encounter plugging of large clumps of slurry solids entering the headbox. The spacing between the distribution roll and the corresponding curved section is preferably between about ¼ and ¾ inches (6.35 and 19.05 mm) for a headbox that is used to distribute a slurry of a gypsum/fiber slurry, as described above, and typically the distribution roll is uniformly spaced about ½ inch (12.7 mm) from curved section.

A weir 50, formed by the intersection of curved sections 36 and 46, separates first horizontal, perforated distribution roll 30 from second horizontal, perforated distribution roll 40.

Figure 5:
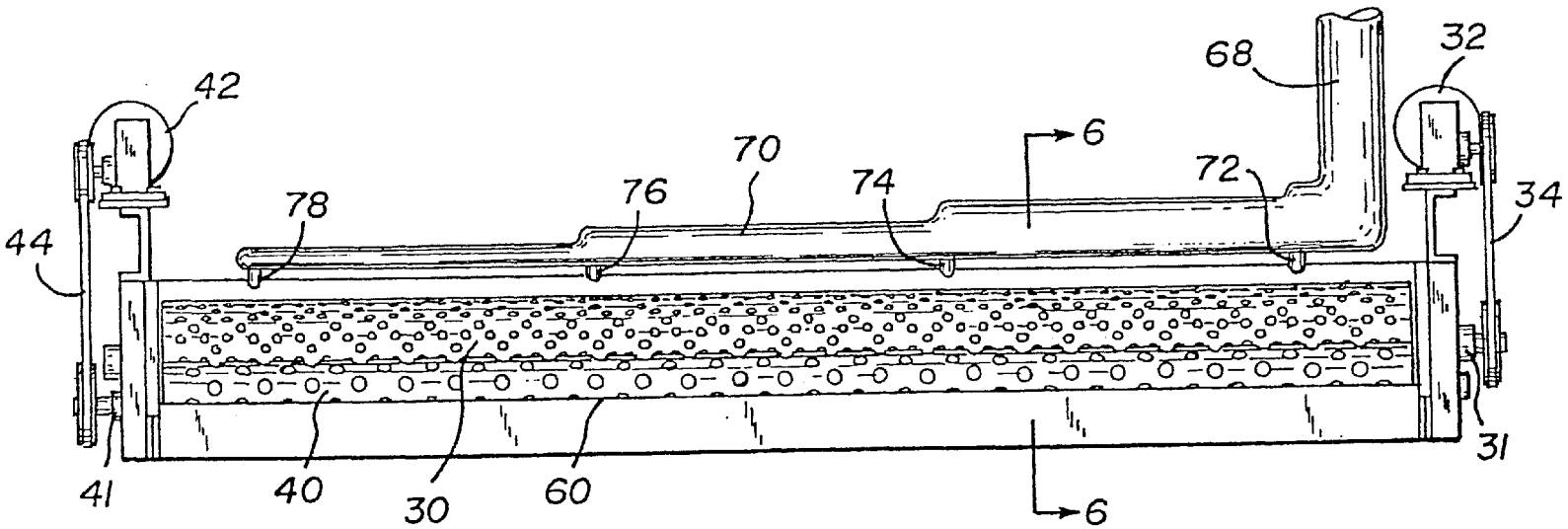
FIG. 5 is a front view of the headbox of my invention.

As is shown by FIG. 5, first distribution roll 30 is suspended from it ends by bearings 31 and is driven by variable speed motor 32 through belt 34. Alternatively, the first distribution roll may be driven using a gearbox. The first distribution roll 30 is preferably about 10 inches (254 mm) in diameter and it extends across the entire width of the Fourdrinier wire 12. From about 25 to about 35% of the cylindrical surface of the first roll may be perforated, i.e. open space, and preferably about 32% of the first roll is open space.

Figure 3:
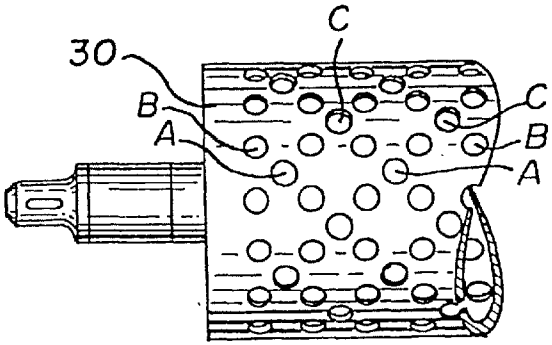
FIG. 3 is a fragmentary detail of the surface of the first distribution roll.

The cylindrical surface of roll 30 is preferably perforated with round holes having a diameter of about one inch (25.4 mm), distributed in a diamond pattern, as is shown in FIG. 3. As roll 30 rotates the row of holes marked A first pass the surface of the aqueous dispersion. Next, the row of holes marked B, which are twice as numerous and laterally offset from the row of holes marked A, pass the surface of the aqueous dispersion. Finally, the row of holes marked C, which are equal in number to row A, but laterally offset from row A and row B, pass the surface of the aqueous dispersion. Thus the diamond pattern presents different open areas at different lateral positions as the roll is rotated, allowing different amounts of gypsum/wood fiber dispersion to pass into and out of the chamber defined by the roll. This creates a pulsing agitation within the chamber defined by the roll that prevents the formation of clumps and breaks up clumps in the gypsum/fiber dispersion that may have formed upstream of the headbox. It has been found that the diamond pattern produces improved mixing which is especially useful when running at low feed rates.

Figure 4:
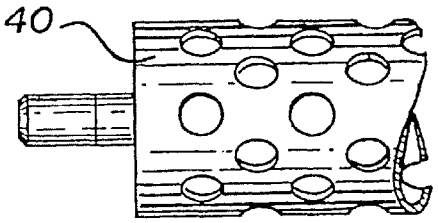
FIG. 4 is a fragmentary detail of the surface of the second distribution roll.

Second distribution roll 40 is suspended from it ends by bearings 41 and is driven by variable speed motor 42 through belt 44. Alternatively, the second distribution roll may be driven using a gearbox. The second distribution roll 40 is preferably about 7 inches (179 mm) in diameter and it also extends across the entire width of the Fourdrinier wire 12. From about 20 to about 30% of the cylindrical surface of the second roll may be perforated, and preferably about 28% of the second roll is open space. The surface of roll 40 is preferably perforated with round holes having a diameter of about one and a half inches (38.1 mm), distributed in a regular pattern as is shown in FIG. 4.

Figure 6:
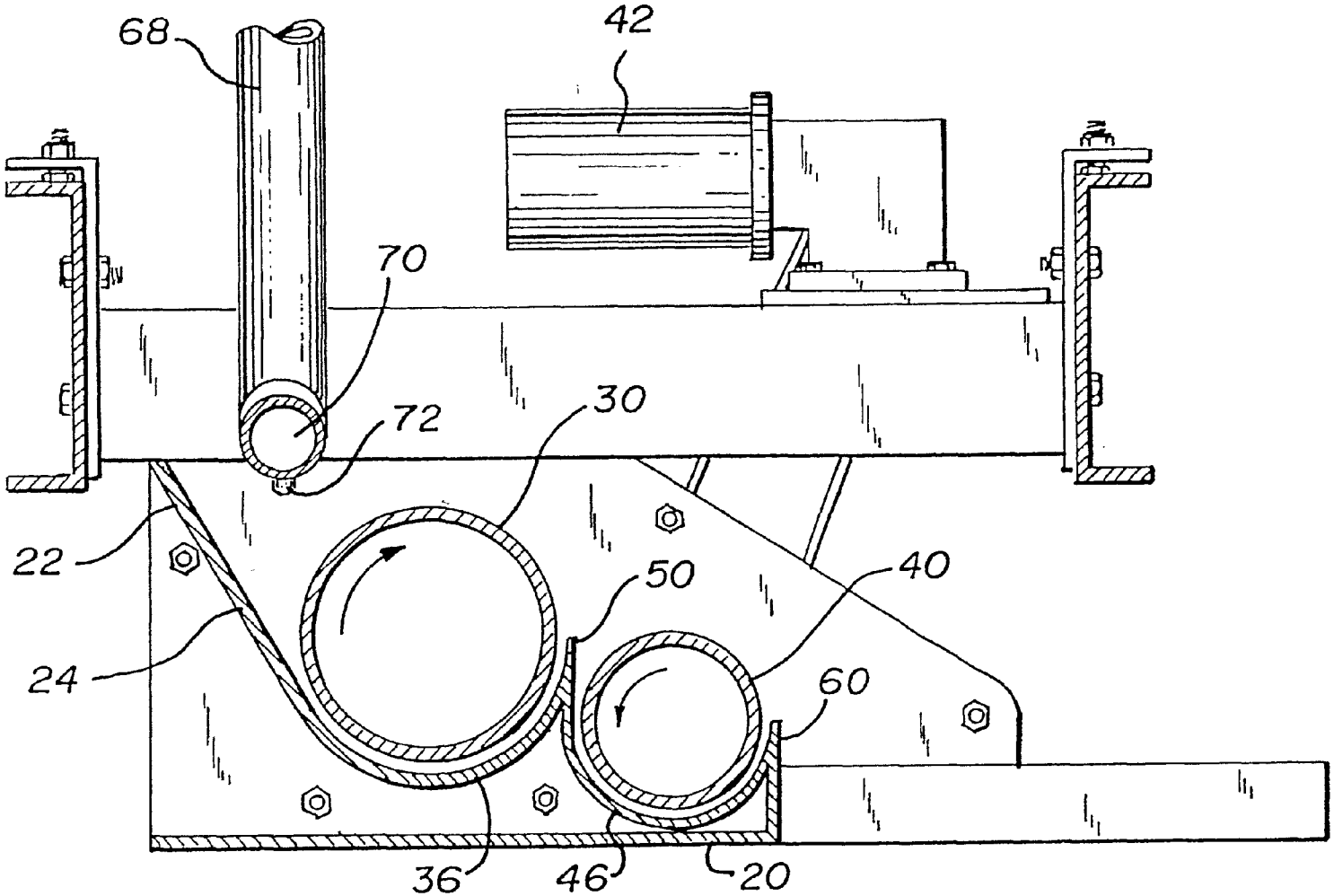
FIG. 6 is a sectional side view of the headbox of my invention, taken along line 6—6 of FIG. 5.

Distribution rolls 30 and 40 are driven in opposite directions, as indicated by FIG. 6. Preferably the rolls are driven at a peripheral speed of from about 120 to 180 feet per minute (36.6 to 54.9 meters per minute). The rotation of the rolls in opposite directions spreads out the calcium sulfate hemi-hydrate/fiber dispersion uniformly across the width of the Fourdrinier wire. Increasing the speed of first distribution roll 30 will increase the viscous drag and provide more opposition to flow and more spreading of the slurry across the width of the headbox. Decreasing the speed of second distribution roll 40 may allow the calcium sulfate hemi-hydrate crystals to settle out of the dispersion while increasing the speed can create a pulsation of the dispersion which may result in non-uniform flow. Increasing the speed of either of the rolls may cause damage to the friable calcium sulfate hemi-hydrate crystals or perlite. The speed of the distribution rolls may be independently varied in order to achieve the desired type and amount of turbulence and maintain the slurry in the deflocculated state without breaking the gypsum crystal components.

As is illustrated by FIG. 5, housing 20 includes first curved section 36 that extends across the width of Fourdrinier forming wire 12. Curved section 36 is closely spaced to the lower portion of first distribution roll 30. The distribution rolls are positioned in the housing wherein the cylindrical surface of the distribution rolls is closely space to the curved section of the housing. Preferably the lower half of roll 30 is uniformly spaced about ½ inch (12.7 mm) from section 36. The rotation of the roll imparts energy to the fluid in the boundary layer of the slurry in contact with the roll. The rotating roll thus causes a pumping and mixing action in the slurry located in the gap between the rotating distribution roll and the static curved section of the housing and thus provides the desired controlled agitation of the gypsum/fiber stock without high shear. The level of agitation is a function of the roll speed and the spacing between the moving surface of the roll and the adjacent static curved section.

Second curved section 46 of housing 20 extends across the width of Fourdrinier forming wire 12. Curved section 46 is closely spaced to the lower portion of second distribution roll 40. Preferably the lower half of roll 40 is uniformly spaced about ½ inch (12.7 mm) from section 46. Curved section 36 of housing 20 intersects curved section 46 of housing 20 to form weir 50, positioned between rolls 30 and 40. Housing 20 also includes sluice 60 which extends vertically downward from curved section 46 and extends across the width of Fourdrinier forming wire 12.

As the space between the roll and the curved section increases, the viscous drag decreases. As a result, the spacing between the rotating roll and the static curved section is important. As this spacing increases at the same roll rpm, the pumping and mixing action of the slurry in the spacing decreases. To maintain the same pumping and mixing action as the spacing between the roll and curved section increases, the roll rpm can be increased. In practice, the spacing between the roll and curved section is minimized so that the greatest range of roll speed can be utilized. The spacing is practically determined by the minimum spacing that does not encounter plugging of large clumps of slurry solids entering the headbox. The spacing between distribution rolls 30 and 40 and corresponding curved sections 36 and 46 is preferably between about ¼ inch and ¾ inch (6.35 and 19.05 mm) for a headbox that is used to distribute a slurry of a gypsum/fiber slurry, as described above, and typically the distribution rolls are uniformly spaced about ½ inch (12.7 mm) from the corresponding curved sections of the housing. The speed of the roll rotation may be independently varied to control flow patterns, but a peripheral speed of about 120 to 180 feet per minute (36.6 to 54.9 meters per minute) is preferred. The peripheral speed of the rolls can be increased above the preferred range to achieve the desired agitation and mixing action so long as the increased peripheral speed does not cause an unacceptable level of damage to the calcium sulfate hemihydrate crystals.

As is shown by FIG. 6, housing 20 also includes input chute 22, formed by sloped section 24 that extends upwardly from curved section 36. Input chute 22, which extends across the width of the Fourdrinier forming wire 12, is designed to receive the hot, aqueous gypsum/fiber dispersion from manifold 70, described below, and deliver the dispersion to the entire width of the opening between first curved section 36 and first distribution roll 30.

Feed manifold 70 is positioned above headbox 10 to deliver hot gypsum/fiber slurry to input chute 22 at multiple points across the width of headbox 10. Hot gypsum/fiber dispersion is passed through feed pipe 68 and into manifold 70 and out of feed nozzles 72, 74, 76 and 78 connected to manifold 70 at locations across the width of the headbox. Preferably manifold 70 is stepped down in cross-sectional area along its length, adjacent to each feed nozzle, as shown in FIG. 5, in order to provide uniform flow rates to all of the feed nozzles.

Figure 7:
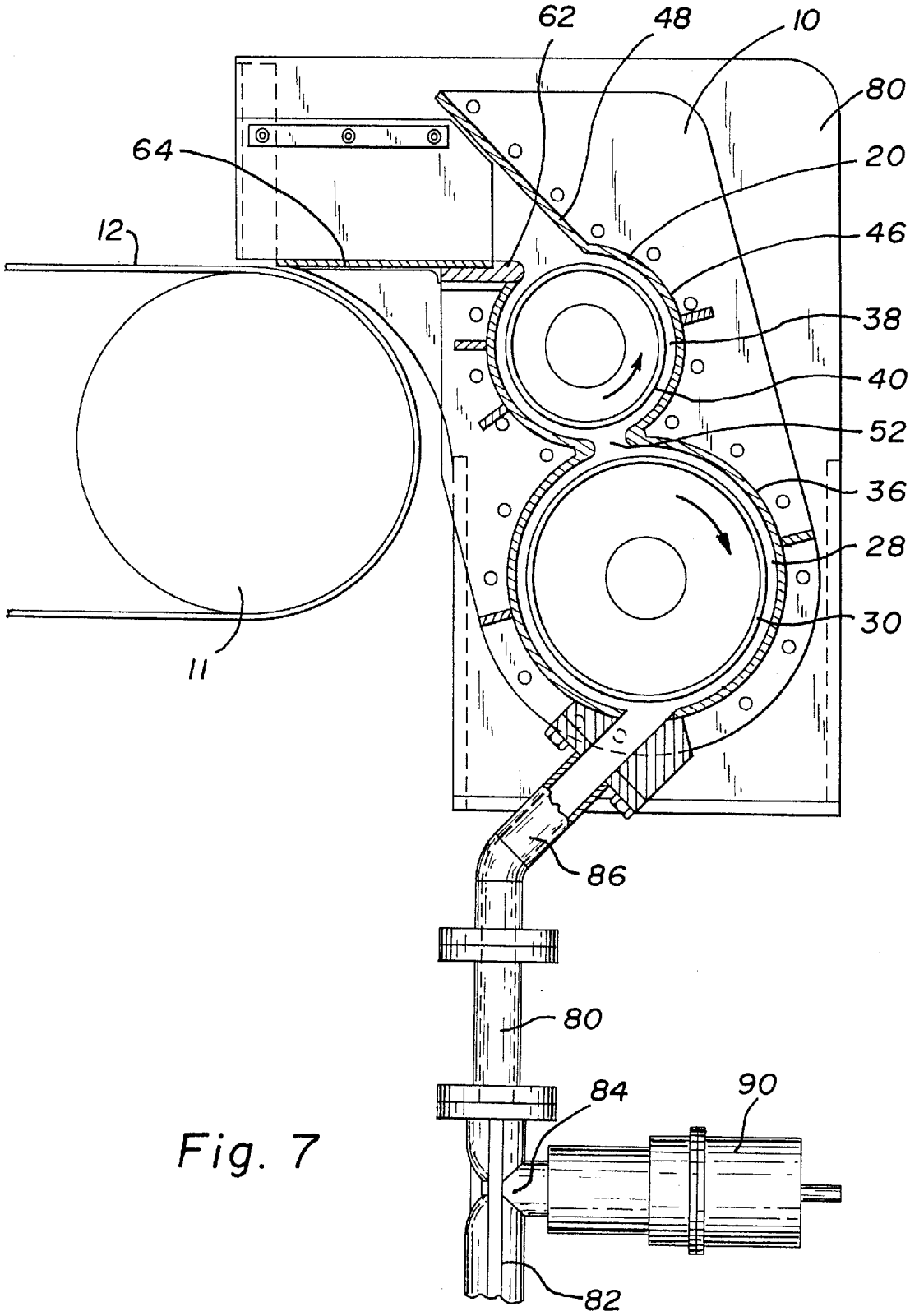
FIG. 7 is a sectional side view of another embodiment of the headbox of my invention.

Another embodiment of the headbox of the present invention is shown in FIG. 7. This embodiment differs from the foregoing embodiment in that the rolls are more or less vertically disposed relative to one another, the curved portion of the housing is extended around the distribution rolls so that the curved section of the housing is closely spaced to the distribution roll throughout most of the slurry/roll interface. As a result, the headbox is essentially closed. In this embodiment, the headbox is preferably fed from below.

In this embodiment, the controlled agitation produced by the boundary layer viscous drag is extended around the first roll for about 300° and around the second roll for at least 270°. It is contemplated that the extended viscous drag allows better control of the headbox in that improved break-up of any slurry clumps can be achieved. Thus, this embodiment with the extended viscous drag provides a smoother, more uniform output of slurry onto the Fordrinier forming wire.

As is shown in FIG. 7, the slurry is fed to the headbox from below by a plurality of feed assemblies 80 that are disposed across the width of the headbox in order to provide a uniform feed of slurry across the width of the headbox. The slurry is passed from a tapered manifold (not shown) to feed assembly 80 that comprises first feed pipe 82, valve 84 and second feed pipe 86 that is connected to the lowermost portion of lower chamber 28 of headbox 10. Motor 90 controls the setting of valve 84 in order to regulate the flow rate of the slurry through each feed assembly 80 into headbox 10. Motors 90 can be remotely controlled or computer controlled to independently adjust the setting of each valve 84 and provide a uniform feed of the slurry across the width of the headbox.

As is shown in FIG. 7, first distribution roll 30 is positioned in lower chamber 28 of housing 20 that includes first curved section 36 that is curved to match the outer cylindrical surface of the first distribution roll 30 and that extends across the width of Fourdrinier forming wire 12. Curved section 36 is closely spaced to most of first distribution roll 30 and preferably, curved section 36 is closely spaced at least 300° of the surface of distribution roll 30. The spacing between distribution roll 30 and curved section 35 is preferably between about ¼ and ¾ inches (6.35 and 19.05 mm) for a headbox that is used to distribute a slurry of a gypsum/fiber slurry, as described above, and typically distribution roll 30 is uniformly spaced about ½ inch (12.7 mm) from curved section 36. The rotation of first distribution roll 30 creates a boundary layer viscous drag, similar to that employed by some centrifugal-style pumps, to provide controlled agitation without high shear to the gypsum/fiber stock in the space between housing section 36 and roll 30.

As is shown in FIG. 7, second distribution roll 40 is positioned in upper chamber 38 of housing 20 that includes second curved section 46 that is curved to match the outer cylindrical surface of the second distribution roll 40 and that extends across the width of Fourdrinier forming wire 12. Curved section 46 is closely spaced to most of second distribution roll 40 and preferably, curved section 46 is closely spaced to at least 270° of the surface of distribution roll 40. The spacing between distribution roll 40 and curved section 46 is preferably between about ¼ and ¾ inches (6.35 and 19.05 mm) for a headbox that is used to distribute a slurry of a gypsum/fiber slurry, as described above, and typically distribution roll 40 is uniformly spaced about ½ inch (12.7 mm) from curved section 46. The rotation of second distribution roll 40 creates a boundary layer viscous drag, similar to that employed by some centrifugal-style pumps, to provide controlled agitation without high shear to the gypsum/fiber stock in the space between housing section 46 and roll 40.

Curved section 36 of housing 20 extends around first roll 30 and intersects curved section 46 of housing 20 along two lines parallel to rolls 30 and 40 to form a throat 52 between lower chamber 28 and upper chamber 38. Throat 52 provides communication for the slurry between lower chamber 28 and upper chamber 38. The width of throat 52, defined as the opening between the parallel lines formed by the intersection of curved section 35 and curved section 46, may be varied over wide limits. A narrower throat causes the slurry to move from lower chamber 28 to upper chamber 38 at a higher velocity that, in turn, provides improved mixing by forcing more slurry through the holes of second distribution roll 40. It is generally preferred to have the curved sections of the chamber to be closely spaced to the surface of the rolls as much as possible, and thus a throat with a relatively narrow opening is preferred. Preferably, the width of the throat is about ¼ inches to 2 inches (6.35 and 50.8 mm). However, a wider throat may be fabricated more easily.

The upper portion of housing 20 includes an opening that is defined by lip 62 and splash shield 48. Lip 62 extends horizontally from curved section 36 and across the width of Fourdrinier forming wire 12. Lip 62 provides a surface over which the gypsum/fiber slurry flows as it passes from headbox 10 onto apron 64 and onto Fourdrinier forming wire 12. Apron 64 is flexible and conforms to the fabric surface of the forming table edges. Lip 62 supports apron 64 in the gap between the headbox 10 and the breast roll 11. Lip 62 is made of stainless steel to minimized corrosion and replacement cost. Apron 64 is made of flexible rubber that is occasionally replaced.

Splash shield 48 also extends horizontally from curved section and across the width of Fourdrinier forming wire 12. Splash shield 48 limits the egress of any slurry that is thrown off second distribution roll 40, which can occur when roll 40 is turned as at a relatively high rpm.

In this embodiment, the feed manifold is positioned below headbox 10 to deliver hot gypsum/fiber slurry to lower chamber 28 at multiple points across the width of headbox 10. Preferably the feed manifold is tapered or stepped down in cross-sectional area along its length, adjacent to each feed nozzle, as shown in FIG. 5, in order to provide uniform flow rates to all of the feed nozzles.

The following examples will serve to illustrate the operation of the headbox of the present invention in the manufacture of a gypsum/fiber board product, but it should be understood that this example is set forth for illustrative purposes and that the headbox of the present invention may be used to manufacture other gypsum fiber products of suitable variations.

EXAMPLE 1

An 8-foot (213.4 cm) wide headbox, in accordance with FIG. 6 of the present invention, was positioned over a Fourdrinier wire. The first distribution roll was 10 inches (254 mm) in diameter and the second distribution roll was 7 inches (177.8 mm) in diameter. The rolls were spaced ½ inch (12.7 mm) from the housing. The rolls were rotated in opposite directions and a peripheral speed of 180 and 120 feet per minute (36.6 to 54.9 meters per minute), respectively. A hot (210° F.) (98.9° C.) aqueous gypsum/fiber slurry, containing 15% by weight of solids and 10% by weight of paper fibers, prepared in accordance with U.S. Pat. No. 5,320,677 to Baig, was fed to the headbox at a rate of 120 gallons (454 liters) per minute. The headbox uniformly distributed the slurry onto the Fourdrinier wire where it was processed into a uniform gypsum/paper fiber board which was ½ inch thick.

EXAMPLE 2

A 12-foot (365.8 cm) wide headbox, in accordance with FIG. 7 of the present invention, was positioned over a Fourdrinier wire. The first distribution roll was 10 inches (254 mm) in diameter and the second distribution roll was 7 inches (177.8 mm) in diameter. The outer cylindrical surface of the distribution rolls was spaced ½ inch (12.7 mm) from the corresponding curved section of the housing. The rolls were rotated in opposite directions as indicated in FIG. 7 and a peripheral speed of 180 and 120 feet per minute (36.6 to 54.9 meters per minute), respectively. A hot (210° F.) (98.9° C.) aqueous gypsum/fiber slurry, containing 15% by weight of solids and 10% by weight of paper fibers, prepared in accordance with U.S. Pat. No. 5,320,677 to Baig, was fed to the headbox at a rate of 900 gallons (3407 liters) per minute through 16 feed assemblies. The valves associated with the feed assemblies were adjusted to provide a uniform flow of slurry out of the headbox onto the apron and onto the Fourdrinier wire where it was processed into a uniform gypsum/paper fiber board which was ½ inch (12.7 mm) thick.

The drawings and the foregoing specification describe the headbox of the present invention with the horizontally disposed distribution rolls, wherein the lowest portions of the distribution rolls are at about the same level, e.g. FIG. 6. The present invention contemplates positioning the distribution rolls at different levels and the distribution rolls being vertically disposed, e.g. FIG. 7.

The drawings and the foregoing specification also describe the headbox of the present invention with an open housing wherein the close spacing between curved sections of the housing and one or both of the distribution rolls extends about half way around the cylindrical surface of the distribution rolls, i.e. about 180°. The present invention also contemplates the use of a housing, which may be either open or closed, wherein either or both of the curved sections of the housing extend further around one or both of the distribution rolls, whereby the close spacing between the curved sections of the housing and one or both of the distribution rolls extends more than 180° around the corresponding distribution rolls. It is preferred to have the curved section of the housing closely spaced to the distribution roll throughout most of the slurry/roll interface.

The forms of invention shown and described herein are to be considered only as illustrative. It will be apparent to those skilled in the art that numerous modifications may be made therein without departing from the spirit of the invention and the scope of the appended claims.

I claim:

1. A water felting process for preparing a board from a suspension of dense crystals and fibrous materials, wherein a foraminous wire mesh is fed the suspension by a headbox comprising a housing, a first rotating horizontal distribution roll positioned in a first chamber of said housing, and a second rotating horizontal distribution roll positioned in a second chamber of said housing, said rolls extending across the width of said headbox, said first chamber including a first curved section shaped to match the outer cylindrical surface of the first roll and being closely spaced to a portion of the surface of the first roll, said second chamber including a second curved section shaped to match the outer cylindrical surface of the second roll and being closely spaced to a portion of the surface of the second roll, said process comprising:

rotating the rolls in opposite directions;

feeding the suspension of dense crystals and fibrous materials to said first chamber;

adjusting the rotational speed of said first roll to impart sufficient energy to the suspension located in the gap between said first closely spaced curved section and the portion of the outer cylindrical surface of the first roll to provide controlled agitation of said suspension without high shear, to maintain said dense crystals in uniform suspension with said fibrous material, and to spread said suspension across the width of paid first roll;

passing said suspension from said first chamber to said second chamber;

adjusting the rotational speed of said second roll to impart sufficient energy to the suspension located in the gap between said second closely spaced curved section and the portion of the outer cylindrical surface of the second roll to provide controlled agitation of said suspension without high shear, to maintain said dense crystals in uniform suspension with said fibrous material, and to spread said suspension across the width of said second roll;

passing said suspension out of said second chamber; and distributing said suspension as a uniform layer across the width of said foraminous wire mesh.

2. A water felting process for preparing a board from a suspension of dense crystals and fibrous materials, wherein a foraminous wire mesh is fed the suspension by a headbox comprising a housing, a first rotating horizontal distribution roll positioned in a first chamber of said housing, and a second rotating horizontal distribution roll positioned in a second chamber of said housing, said rolls extending across the width of said headbox, said first chamber including a first curved section shaped to match the outer cylindrical surface of the first roll and being closely spaced to a portion of the surface of the first roll, said second chamber including a second curved section shaped to match the outer cylindrical surface of the second roll and being closely spaced to a portion of the surface of the second roll, said process comprising:

rotating said rolls;

feeding the suspension of dense crystals and fibrous materials to said first chamber;

adjusting the rotational speed of said first roll to impart sufficient energy to the suspension located in the gap between said first closely spaced curved section and the portion of the outer cylindrical surface of the first roll to provide controlled agitation of said suspension without high shear, to maintain said dense crystals in uniform suspension with said fibrous material, and to spread said suspension across the width of said first roll;

passing said suspension from said first chamber to said second chamber;

adjusting the rotational speed of said second roll to impart sufficient energy to the suspension located in the gap between said second closely spaced curved section and the portion of the outer cylindrical surface of the second roll to provide controlled agitation of said suspension without high shear, to maintain said dense crystals in uniform suspension with said fibrous material, and to spread said suspension across the width of said second roll;

passing said suspension put of said second chamber and distributing said suspension as a uniform layer across the width of said foraminous wire mesh.

3. The water felting process of claim 2, wherein said first distribution roll rotates toward (countercurrent) the incoming suspension and said second distribution roll rotates with (concurrent) the incoming suspension.

4. The water felting process of claim 2, wherein said distribution rolls are rotated at different speeds.

5. The water felting process of claim 2, wherein the lowest portion of said first distribution roil is positioned at a higher level than the lowest portion of said second distribution roll.

6. The water felting process of claim 2, wherein boundary layer viscous drag agitation is provided by said first curved section being closely spaced to approximately 180° of the outer cylindrical surface of said first distribution roll.

7. The water felting process of claim 2, wherein boundary layer viscous drag agitation is provided by said second curved section being closely spaced to approximately 180° of the outer cylindrical surface of said second distribution roll.

8. The water felting process of claim 2, wherein said suspension passes over a weir formed between said distribution rolls by the intersection of said curved sections.

9. The water felting process of claim 2, wherein said first distribution roll is vertically disposed beneath said second distribution roll.

10. The water felting process of claim 2, wherein said housing is essentially closed.

11. The water felting process of claim 2, wherein boundary layer viscous drag agitation is provided by said first curved section being closely spaced to more than 300° of the outer cylindrical surface of said first distribution roll.

12. The water felting process of claim 2, wherein boundary layer viscous drag agitation is provided by said second curved section being closely spaced to more than 180° of the outer cylindrical surface of said second distribution roll.

13. The water felting process of claim 2, wherein said suspension passes through a throat formed by said first curved section extending around said first roll to intersect said second curved section along two lines, said lines forming said throat between said rolls, said throat extending across the width of said rolls.

14. The water felting process of claim 2, wherein said suspension is fed to said headbox from below said headbox.

15. The water felting process of claim 14, wherein said suspension is fed to said headbox through a feed manifold having multiple feed outlets distributed across the width of said headbox, said outlets adapted to feed said suspension to the space between said housing and the lower portion of said first distribution roll.

16. The water felting process of claim 15, wherein the cross sectional area of said feed manifold is stepped to equalize the suspension feed rate across the width of the head box.

17. The water felting process of claim 2, wherein said suspension is passed through a chamber in which the distribution roll is perforated.

18. The water felting process of claim 17, wherein said suspension is passed through a first chamber in which the distribution roll is perforated over about 25 to 35% of its surface and through a second chamber in which the distribution is perforated over about 20 to 30% of its surface.

19. The water felting process of claim 18, wherein said suspension is passed through a first chamber in which the distribution roll that is perforated by holes arranged in a diamond pattern.

20. The water felting process of claim 2 wherein said suspension is fed to said headbox from above said headbox.

21. The water felting process of claim 20 wherein said suspension is fed to said headbox through an overhead feed manifold having multiple feed nozzles distributed across the width of said distribution rolls, said nozzles positioned adjacent to the space between said housing and said first distribution roll, said nozzles adapted to feed said suspension to the space between said housing and said first distribution roll.

22. The water felting process of claim 21, wherein the cross sectional area of said feed manifold is stepped to equalize the suspension feed rate across the width of the headbox.

* * * * *